US008045737B2

(12) United States Patent
Stirnemann

(10) Patent No.: US 8,045,737 B2
(45) Date of Patent: Oct. 25, 2011

(54) METHOD OF OBTAINING SETTINGS OF A HEARING INSTRUMENT, AND A HEARING INSTRUMENT

(75) Inventor: Alfred Stirnemann, Zollikon (CH)

(73) Assignee: Phonak AG, Stafa (CH)

( * ) Notice: Subject to any disclaimer, the term of this patent is extended or adjusted under 35 U.S.C. 154(b) by 1471 days.

(21) Appl. No.: 11/365,327

(22) Filed: Mar. 1, 2006

(65) Prior Publication Data

US 2007/0217639 A1 Sep. 20, 2007

(51) Int. Cl.
*H04R 25/00* (2006.01)

(52) U.S. Cl. ..... 381/318; 381/312; 381/321

(58) Field of Classification Search ..... 381/58, 381/60, 93, 312, 314, 318, 320, 321, 83, 381/107, 108

See application file for complete search history.

(56) References Cited

U.S. PATENT DOCUMENTS

| | | | | |
|---|---|---|---|---|
| 4,596,902 | A | 6/1986 | Gilman | |
| 6,134,329 | A * | 10/2000 | Gao et al. | 381/60 |
| 6,658,122 | B1 | 12/2003 | Westermann et al. | |
| 7,010,135 | B2 * | 3/2006 | Von Buol | 381/318 |
| 7,536,022 | B2 * | 5/2009 | Von Buol | 381/318 |

FOREIGN PATENT DOCUMENTS

| | | | |
|---|---|---|---|
| CH | 678692 | A5 | 10/1991 |
| DE | 2808516 | A1 | 9/1979 |
| DE | 4128172 | A1 | 3/1993 |
| EP | 1309255 | | 5/2003 |
| EP | 1594344 | A2 | 11/2005 |
| EP | 1624719 | A2 | 2/2006 |
| WO | 0028784 | A1 | 5/2000 |
| WO | 02/13640 | A1 | 2/2002 |

OTHER PUBLICATIONS

U.S. Appl. No. 11/224,791, filed Sep. 13, 2005, Von Buol.
European Search Report dated Oct. 26, 2006 in reference to European application No. EP06405088.

* cited by examiner

*Primary Examiner* — Huyen D Le
(74) *Attorney, Agent, or Firm* — Pearne & Gordon LLP

(57) ABSTRACT

According to the invention, a real ear acoustic coupling quantity representative of the acoustic coupling of a hearing instrument to the user's ear or an anatomical transfer quantity—for example the Real-Ear-to-Coupler-Difference (RECD), the Microphone Location Effect (MLE), the Coupler Response for Flat Insertion Gain (CORFIG), and/or the Real Ear Open Gain (REOG)—is obtained from a transfer function representative of an acoustic transfer from the receiver to the outer microphone such as a signal feedback threshold gain. The obtained quantity may be used for setting a fitting parameter of the hearing instrument, for example a gain correction.

21 Claims, 6 Drawing Sheets

$$\begin{bmatrix} \text{RECD} \end{bmatrix} = \begin{bmatrix} \text{M} \end{bmatrix} \begin{bmatrix} \text{fb} \end{bmatrix}$$

$$\begin{bmatrix} \text{RECD} \end{bmatrix} = \begin{pmatrix} 0 & 0 & m_{13} & 0 & 0 \\ m_{21} & m_{22} & 0 & 0 & 0 \\ 0 & 0 & 0 & 0 & m_{35} \\ 0 & 0 & 0 & m_{44} & 0 \\ m_{51} & 0 & 0 & m_{54} & 0 \end{pmatrix} \begin{bmatrix} \text{fb} \end{bmatrix}$$

$$\begin{bmatrix} \text{RECD} \end{bmatrix} = \underbrace{\left[ \begin{bmatrix} \text{M} \end{bmatrix} \begin{bmatrix} \text{M}_v \end{bmatrix} \right]}_{\text{T}} \left\{ \begin{matrix} \begin{bmatrix} \text{fb} \end{bmatrix} \\ \begin{bmatrix} \text{v} \end{bmatrix} \end{matrix} \right\}$$

METHOD OF OBTAINING SETTINGS OF A HEARING INSTRUMENT, AND A HEARING INSTRUMENT

FIELD OF THE INVENTION

The invention is in the field of signal processing in hearing instruments. It more particularly relates to a method for obtaining a real ear acoustic coupling quantity representative of the acoustic coupling of a hearing instrument to the user's ear, to a method for setting a fitting parameter in a digital hearing instrument, and to a hearing instrument.

BACKGROUND OF THE INVENTION

For a correct fitting of hearing instruments, the acoustic coupling of the hearing instrument at the ear plays an important role. The acoustic coupling includes the transmission of the electrical signal from the power amplifier through receiver, hook and tubing (in the case of a behind-the-ear, hearing instrument), ear mold and ear canal to the eardrum. In practice, this transmission path is not directly specified. Rather, conventionally, for modeling the effective gain provided by a hearing instrument placed in an ear canal, measurements in a so-called "2 cc coupler" are used. However, this model system merely provides an influence of an average ear canal on the effective gain provided by a hearing instrument. The accuracy of such a model system is limited. The difference between the signal level in the real ear and the level in the 2 cc coupler is often called "Real Ear to Coupler Difference" RECD. For the RECD, generally the fitting software supplies a value, which depends on the hearing instrument style (whether the hearing instrument is a behind-the-ear (BTE), in-the-ear (ITE), in-the-ear-canal (ITC), completely-in-the-canal (CIC) etc. hearing instrument). Thus, the influences of the electro acoustic hearing instrument characteristics (receiver, hook damping) as well as the individual tubing are not thought of. In addition, also user specific individual differences are not considered. Such individual differences may be up to 10-15 dB, due to the different residual ear canal volume and ear drum impedance. For low frequencies, the RECD may be corrected by the so-called vent loss to account for the effect of a vent in the earpiece of the hearing instrument.

The only way for properly correcting the individual RECD known so far is the application of measurements, which use directly the corresponding hearing instrument for the measurement and rely on the introduction of a probe into the user's ear. However, such measurements, which are sometimes called "RECD direct" measurements, are laborious and require a special probe. Also, the introducing of a probe into the ear may cause artifacts. In summary, the following problems arise

- No consideration of individual anatomical parameters that affect the RECD, such as residual ear canal volume, distance to the ear drum, ear drum impedance, transmission characteristics of the middle ear.
- Unknown leakage of the ear mold.
- Incorrect compensation of the vent loss, since the effective vent size is unknown.
- No consideration of the individual tubing.
- individual RECD differences up to 10-15 dB.
- RECD direct measurements are very time consuming.
- RECD direct measurements use a microphone probe which produces additional leakage.

- Measurements of the Microphone Location Effect (MLE) and the Open Ear Gain (OEG, also called Real Ear Unaided Gain REUG) are very sensitive to room acoustics.

It is therefore an object of the present invention to provide a method of obtaining a real ear acoustic coupling quantity or an anatomical transfer quantity for adjusting fitting parameters of a hearing instrument which does not rely on the introduction of a separate (from the hearing instrument) microphone probe into the user's ear and which accounts for individual RECD differences.

An "acoustic coupling quantity" is any quantity that relates to the relation between an output of the hearing instrument and the sound impinging on the user's eardrum. Acoustic coupling quantities include the RECD, the CORFIG (Coupler Response for Flat Insertion Gain), the REOG (Real Ear Open Gain), combinations of these, combinations of these with anatomical transfer quantities, and others. An anatomical transfer quantity is any quantity that relates to how a given sound wave input is affected by the diffraction and reflection properties of the head, pinna, and torso, before the sound reaches the eardrum. Anatomical transfer functions (also called head related transfer functions, HRTFs) are examples of anatomical transfer quantities and include MLE (basically the dependence of the sound level on the exact position close to the ear), and the OEG.

The aforementioned object is achieved by the method for obtaining a real ear acoustic coupling quantity or an anatomical transfer quantity as defined in independent claim 1. The invention also concerns a method for setting a fitting parameter, and a hearing instrument.

According to an aspect of the invention, a real ear acoustic coupling quantity representative of the acoustic coupling of a hearing instrument to the user's ear or an anatomical transfer quantity—for example the Real-Ear-to-Coupler-Difference (RECD), the Microphone Location Effect (MLE), the Coupler Response for Flat Insertion Gain (CORFIG), and/or the Real Ear Open Gain (REOG)—is obtained from a transfer function representative of an acoustic transfer from the receiver to the outer microphone such as a signal feedback threshold gain. The obtained (predicted) quantity may be used for setting a fitting parameter of the hearing instrument, for example a gain correction.

Accordingly, a method for obtaining a real ear acoustic coupling quantity of a hearing instrument to a user's ear or an anatomical transfer quantity is provided, the method comprising the step of providing a hearing instrument placed in or at a user's ear, the hearing instrument comprising at least one outer microphone operable to obtain an input signal from an acoustic signal incident on the user's ear, and at least one receiver operable to produce an output acoustic signal for impinging on the user's eardrum, the method comprising the further steps of obtaining a transfer function representative of an acoustic transfer from the receiver to outer microphone and of performing a computation of said real ear acoustic coupling quantity or anatomical transfer quantity, wherein in said computation the transfer function is used as an input quantity.

Further, a method for setting at least one fitting parameter of a digital hearing instrument is provided, the method including the step of providing the hearing instrument placed in or at a user's ear, the hearing instrument comprising at least one outer microphone operable to obtain an input signal from an acoustic signal incident on the user's ear, and at least one receiver operable to produce an output acoustic signal for impinging on the user's eardrum, the method comprising the further steps of obtaining a transfer function representative of an acoustic transfer from the receiver to outer microphone, of performing a computation of said real ear acoustic coupling quantity or anatomical transfer quantity, wherein in said computation the transfer function is used as an input quantity and of setting the fitting parameter or fitting parameters dependent on said obtained quantity.

The invention also concerns a hearing instrument comprising at least one outer microphone, a signal processing unit with a data memory, and at least one receiver, the signal processing unit being operable to transform an input signal provided by said at least one outer microphone into an output signal supplied to said at least one receiver, the transformation of the input signal into the output signal defining a signal gain applied by the signal processing unit, the signal processing unit being operable to compute said gain including gain values below a signal feedback threshold gain by a computation in which a transfer function representative of an acoustic transfer from the receiver to the outer microphone is used as an input quantity.

If the hearing instrument comprises more than one outer microphone and/or more than one receiver, the named transfer function is a transfer function from either or a combination of the receivers to either or a combination of the outer microphones.

The invention is based on the surprising insight that there is a relation between the individual real ear acoustic coupling and anatomical transfer quantities—indicative of the "forward" transfer of sound to the ear, towards the ear drum, such as the RECD—and transfer functions representative of an acoustic transfer from the receiver to the outer microphone ("backward" transfer) such as the feedback threshold. Such "backward" transfer functions are, under certain circumstances, comparably easy to determine, and can be measured using the built-in standard components of a hearing instrument.

In the following, a reasoning accounting for the relation between the transfer function representative of an acoustic transfer from the receiver to the outer microphone and the acoustic coupling or anatomical transfer quantity is provided referring to the example of the feedback threshold and the RECD only. However, it has been shown experimentally that the relations also hold for other transfer functions/quantities. FIG. 1 shows the fundamental relations between (logarithmic) gain values in the hearing instrument referring to the example of a BTE hearing instrument, where the at least one receiver is placed in the behind-the-ear component and is connected to the earpiece via hook and tubing. A feedback path via the vent is assumed. In FIG. 1, 2 ccG denotes the 2 cc Gain (the acoustic gain realized in the 2 cc coupler), "SENSIN" the input sensitivity, which is mainly governed by the properties of the at least one microphone of the hearing instrument, "SENSOUT" the output sensitivity, which primarily depends on the properties of the at least one receiver, "GDSP" the gain produced by the digital signal processing stage, "MLE" the microphone location effect, "r/h" the influence of the coupling of the at least one receiver to the hook and the influence of the hook, "t/m" the influence of tubing and earmold, "canal" the gain in the ear canal, i.e. from the earmold to the eardrum. "vent path" is the gain of the signal transmitted back from the ear canal through the vent to the microphone (which is the predominant cause of feedback), and "REAG" is the real ear aided gain. Level A (highlighted by a dashed arrow) represents a first situation where the hearing instrument is connected to a 2 cc coupler, and the acoustic gain 2 ccG being the difference between the logarithmic Sound pressure level (SPL) in the 2 cc coupler and the SPL in the free field is measured. Level B refers to a second situation where a test signal is supplied to the at least one receiver, this situation defining the RECD. Level C addresses the third situation, where the hearing instrument is inserted into the user's ear.

In state-of-the-art fitting processes, the REAG, which is the fundamental quantity reproducing the relation between the SPL at the place of the at least one microphone and the SPL at the eardrum (aided ear drum SPL), is usually determined by:

$$REAG=MLE-SENSIN+GDSP+SENSOUT+RECD \quad (1)$$

This relationship follows directly from FIG. 1. As in the equations further below, the frequency dependence of the involved quantities is not explicitly pointed out in equation (1). In practice, the MLE is usually neglected, the quantity −SENSIN+GDSP+SENSOUT is the 2 cc gain that can be measured in the 2 cc coupler, and the RECD is, in accordance with state-of-the-art fitting processes, crudely estimated from the hearing instrument type.

In the patent application publication EP 1 309 255 and the U.S. patent application Ser. No. 11/224791 which are incorporated herein by reference in their entirety, a method of measuring the feedback threshold as a function of the frequency has been disclosed.

In these documents, it is shown that the gain in the forward direction is equal to the damping of the feedback path, i.e. the sum of all gains in the feedback loop is equal to zero. Thus, one gets the following relationship for the gains in FIG. 1:

$$-\mathrm{SENSIN}+GDSP+r/h+t/m+vent\ path=0 \quad (2)$$

The DSP gain is normally converted into the 2 cc gain:

$$2\ \mathrm{ccGain}=GDSP+\mathrm{SENSOUT}-\mathrm{SENSIN} \quad (3)$$

The individual RECD is defined as $$RECD=r/h+t/m+\mathrm{canal}-\mathrm{SENSOUT} \quad (4)$$

Equations (2) and (3) substituted into equation (4) yield:

$$RECD=\mathrm{canal}-\mathrm{vent\ path}-2\ \mathrm{ccGain} \quad (5)$$

This relationship can be seen directly in FIG. 1. Whereas equation (5) is only valid in the situation of the measurement of the feedback threshold in accordance with EP 1 309 255/U.S. Ser. No. 11/224791, and is, primarily due to the sound pressure level dependence of 2 ccGain, not valid for all sound intensities, RECD is an approximately linear quantity which only depends on the frequency. Therefore, the RECD value obtained through equation (5) at the feedback threshold is significant for all sound intensities. It is further independent of the way the feedback threshold is obtained. Thus, the method disclosed in EP 1 309 255/U.S. Ser. No. 11/224791 is not a prerequisite for the approach in accordance with the invention.

Since SENSIN and SENSOUT are known and GDSP is the measured feedback limit, the quantity 2 ccGain=GDSP+SENSOUT−SENSIN is also known. For low frequencies, the damping by the ear canal can be neglected, so that the ear canal gain is approximately 0 dB. For BTE hearing instruments, the vent path attenuation can be approximated by $$ventpath \approx 20\log\left(\frac{d^2}{8rl}\right), \quad (6)$$

where d is the vent diameter, l the length of the vent, and r the distance between the vent and the microphone. (For ITE hearing instruments, where the microphone(s) may be close to the vent, values obtained by equation (6) have to be corrected.) Thus, for low frequencies one gets a simple linear relationship between the RECD and the feedback threshold. For higher frequencies, however, the relationship becomes complex: the ear canal transfer function depends on the distance to the ear drum ($\lambda/4$ resonance), the vent path is determined by the vent length and possible concha effects, and the feedback threshold cannot be measured by the method described in EP 1 309 255 for high and very low frequencies due to the limited power of the hearing instrument. However, a relation between the feedback threshold and the RECD exists also in more complex situations than in the low frequency approximation range. The experimental findings reproduced in the correlation diagram of FIG. 2 show this relation. FIG. 2 shows the measured correlation, for a variety of behind-the-ear hearing instruments worn by different persons, between the feedback threshold and the RECD, both as a function of the frequency. In FIG. 2 stronger correlations are represented by dark shadings, whereas light shadings represent weak correlations. In the figure, the correlation between the feedback threshold and the low frequency RECD is predominantly positive, whereas for higher frequencies above 1.5-2 kHz, there is a strong negative correlation between the RECD and the feedback threshold.

Extended experiments (not shown) have revealed, that even if measurements are made for different hearing instrument types (BTE, ITE, CIC etc.) and averaged, there is still a significant correlation that can be used for RECD prediction. Moreover, experiments have also shown that not only the RECD but also other real ear acoustic coupling and anatomical transfer quantities such as the Open Ear Gain (OEG), the Microphone Location Effect (MLE), and the combined quantity Coupler Response for Flat Insertion Gain (CORFIG) are correlated to the feedback threshold. Furthermore, such a correlation does not only exist for the feedback threshold but also for the acoustic transfer at sound levels below the threshold. Such transfer function can for example be measured if a pre-determined signal, such as a MLS-signal acts on the receiver, and the response of the at least one outer microphone is measured.

The insight that there is a relationship between the feedback limit (and other transfer functions) and the RECD (and other real ear acoustic coupling and anatomical transfer quantities) may thus be used independent of the above equations. Instead of relying on the above mentioned simple linear relationship, preferably a generalized model is used, for example a multiple input/multiple output model, which is used to predict the acoustic coupling quantity (for example directly represented by a fitting/gain parameter) for different frequency bands. Also, whereas the above discussed low frequency approximation depends on the assumption that the feedback path is dominated by the vent's contribution, the generalization does not. In other words, it is not excluded that a generalized model can possibly also account for feedback contributions by other channels, such as 'mechanical' feedback (due to vibrations of casing, human tissue, etc.) and others.

The invention allows to directly estimate the individual's RECD based on a measurement, which is often performed anyway when a hearing instrument is fitted. Whereas the measurement itself addresses only one parameter, the estimate incorporates effects such as vent loss, leakage, remaining ear canal volume, eardrum impedance, and tubing. Thus, systematic fitting errors are avoided, and an individual hearing instrument frequency characteristics is obtained. It is not necessary to perform laborious measurements such as the mentioned "RECD direct" measurement. Since the ordinary input microphone (or input microphones) may be used for a measurement of the feedback threshold, no extra hardware is required. If the method according to the invention further is combined with the feedback threshold measurement method of EP 1 309 255/U.S. Ser. No. 11/224791, the measurement for obtaining initial hearing instrument settings is also very quick.

In this text, RECD, other real ear acoustic coupling quantities and feedback threshold are assumed to be dependent only on the frequency for a given hearing instrument and a given user in a given surrounding. They can be represented by a corresponding curve, i.e. a function of the frequency. In practice, the curves are often represented by a number of discrete values, each representing a frequency band. In the case of more than one outer microphones, the predicted quantity may also be dependent on the direction. Of course, it is not excluded that the predicted quantity may also depend on further variables.

As indicated, although the above discussion relates to the estimation of the RECD, the invention is not restricted to estimating this quantity. Instead, other values indicative of the real ear acoustic coupling or the anatomical transfer may be determined and used. Examples are the Real Ear Occluded Gain (REOG), the Coupler Response for Flat Insertion Gain CORFIG=OEG−RECD−MLE (the CORFIG representing the—hypothetical—output in the 2 cc coupler for the case in which the real ear insertion corresponds to a target gain), and/or the MLE and/or the OEG etc. In practice, the RECD and possibly other quantities may be determined from the named transfer function by a fitting software external to the hearing instrument. This may be done during a fitting process. The fitting software may supply the RECD values to the hearing instrument, which RECD values may replace the default RECD values stored in the hearing instrument. These values may then be used directly as a gain correction. As an alternative, the computation of the RECD (or other quantity) may be done by the digital signal processor of a hearing instrument itself. This may ultimately lead to a "self-fitting" hearing instrument which may adjust itself, so that merely the desired sound level has to be actively chosen by a hearing professional or even a user. It is also not excluded that the real ear acoustic coupling quantity is represented directly by way of fitting parameter values.

According to another aspect of the invention, therefore, the feedback threshold is used as an input quantity for computing a signal processing unit gain, which gain may lie below the feedback threshold. Thus, in accordance with the invention, fitting parameters of the hearing instrument influencing the instrument's gain in operation below the feedback threshold are set based on values obtained by a feedback threshold measurement. The feedback threshold, therefore, is used to influence the hearing instrument's (or its signal processing unit's) gain characteristic not only by setting a maximum gain below the feedback threshold, but for a large range of different input signal strengths (sound intensities). For example, the gain may be influenced for all sound intensities between the user's hearing threshold level and a maximum sound intensity being a threshold of noise pain or a maximum level of comfortable hearing.

According to this second aspect, the gain G in the signal processing unit is for example computed to be a function of the feedback threshold and further parameters, which preferably include the frequency (or frequency band) and the signal intensity and may further include the time, history, user defined settings, average signal length, cepstral values, etc. Of course, the gain may further be limited by the feedback threshold as a maximum gain. Thus, the gain G may be defined as:

$$G(f)=\min\{G(f,fb)(f),I(f),p_1,\ldots,p_n),fb(f)\} \quad (7)$$

where f denotes the frequency (possibly represented by discretized values), fb the feedback threshold gain, I the signal intensity, and $p_1,\ldots,p_n$ optional further parameters. In contrast to state-of-the-art processes, the feedback threshold gain has an influence on G(f) not only by setting a frequency dependent upper limit but also for G(f) values well below the feedback threshold.

Also other acoustic coupling quantities may be used for influencing a hearing instrument's gain characteristics.

Among the anatomical transfer quantities, the OEG may be used not to set gain parameters of the hearing instrument, but to calculate a correction to the input signal, which correction accounts for the difference between the free field sound level and the level measured at the place of the outer microphone(s). As an example, a frequency band OEG correction may be applied to the digitized electric input signal before gain values are calculated by the signal processing unit.

Various further applications of the obtained predicted acoustic coupling or anatomical transfer quantity are possible, for example measuring of impedances, etc.

The term "hearing instrument" or "hearing device", as understood in this text, denotes on the one hand hearing aid devices that are therapeutic devices improving the hearing ability of individuals, primarily according to diagnostic results. Such hearing aid devices may be Behind-The-Ear (BTE) hearing aid devices or In-The-Ear (ITE) hearing aid devices (including the so called In-The-Canal (ITC) and Completely-In-The-Canal (CIC) hearing aid devices, as well as partially and fully implanted hearing aid devices). On the other hand, the term stands for devices which may improve the hearing of individuals with normal hearing, e.g. in specific acoustic situations as in a very noisy environment or in concert halls, or which may even be used in the context of remote communication or of audio listening, for instance as provided by headphones. Further the hearing instrument may also be an earprotector where the output acoustic signal level may be lower than the input acoustic signal level.

The hearing devices addressed by the present invention are so-called active hearing devices which comprise at the input side at least one acoustic to electrical converter, such as a microphone, at the output side at least one electrical to acoustic converter, such as a loudspeaker (often also termed "receiver"), and which further comprise a signal processing unit for processing signals according to the output signals of the acoustic to electrical converter and for generating output signals to the electrical input of the electrical to mechanical output converter. In general, the signal processing circuit may be an analog, digital or hybrid analog-digital circuit, and may be implemented with discrete electronic components, integrated circuits, or a combination of both. In the context of this application, signal processing units comprising digital signal processing means are preferred. The hearing devices may optionally comprise further active components including an inner acoustic-to-electric converter which is placed on the proximal side of an earpiece (in contrast to the standard outer microphones which are on the distal side of the earpiece).

BRIEF DESCRIPTION OF THE DRAWINGS

In the following, the invention and embodiments thereof will be described with reference to drawings, in the drawings

DESCRIPTION OF THE PREFERRED EMBODIMENTS

Figure 3:
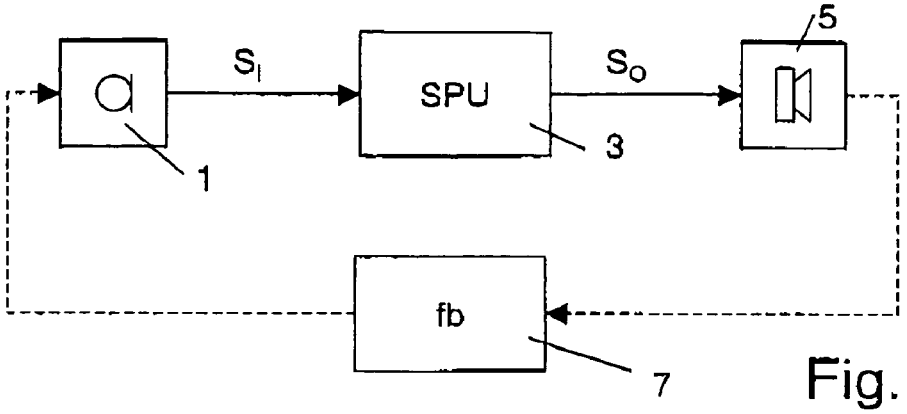
FIG. 3 shows a diagram of a hearing instrument.

The hearing instrument of FIG. 3 comprises at least one acoustic-to-electric converter (microphone) 1. Often, two or even three acoustic-to-electric converters are available in each hearing instrument. The hearing instrument further comprises a signal processing unit (SPU) 3 operable to apply a time- and/or frequency-dependent gain to the input signal or input signals $S_I$ resulting in an output signal $S_O$ and at least one electric-to-acoustic converter (receiver) 5. The feedback path 7 is also shown in the figure.

In accordance with the invention, it is proposed to estimate, from the feedback threshold that has been determined in accordance with any suitable method, a quantity representative of the real ear acoustic coupling, which quantity is preferably sound level independent. An example of such a quantity is the RECD. The models for obtaining a real ear acoustic coupling quantity, which are described in the following, all refer to the example of the RECD. It is to be noted, however, that they also apply for predicting other acoustic coupling quantities or anatomical transfer quantities such as the COR-FIG, the OEG, the MLE etc.

Figure 4:
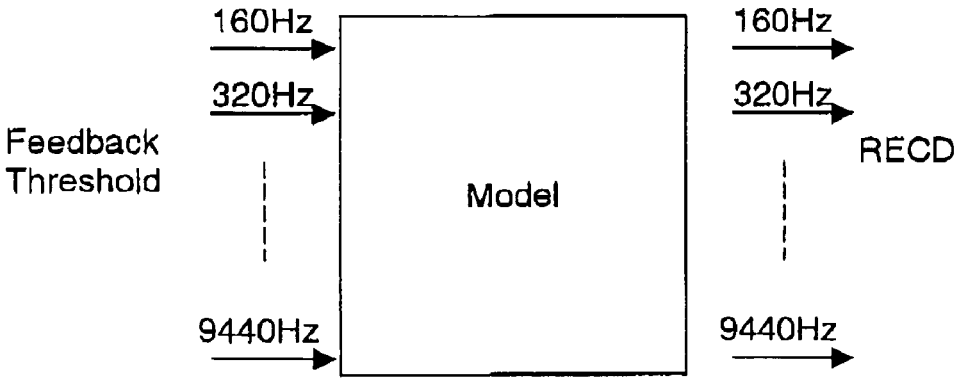
FIG. 4 shows a basic configuration to predict the RECD from the feedback threshold.

FIG. 4 shows the basic configuration for the estimation of the RECD in a number of frequency bands from the feedback threshold represented in a number of frequency bands. Any model by which an RECD may be calculated from the feedback threshold may be applied.

Figures 5, 6, 7:
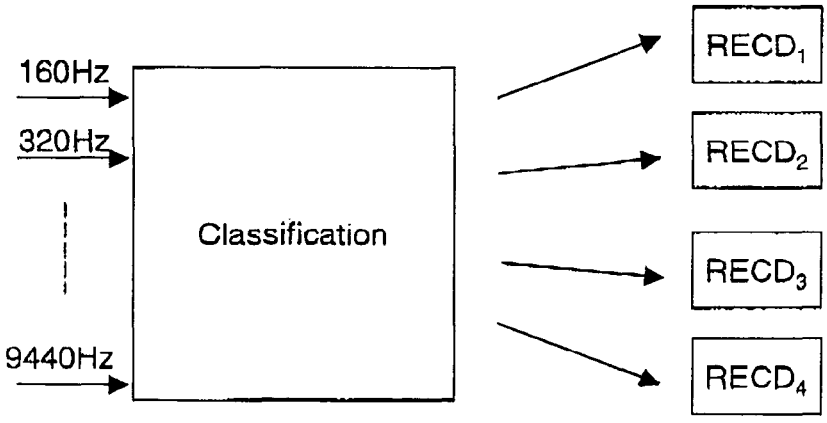
FIG. 5 shows an implementation of the configuration of FIG. 4 by a linear model.
FIG. 6 shows, for the example of five frequency bands, a linear transformation model with significant coefficients only, which are obtained by stepwise regression.
FIG. 7 shows a classification model.

FIG. 5 depicts a first example of such a model, namely a linear transformation of the feedback threshold spectrum to yield the RECD spectrum. In the example of representation of the feedback threshold fb and the RECD by logarithmic (for example dB) values in discrete bands, the linear transformation may be represented by an n x n-Matrix of constant values, where n is the number of bands. In situations, where the frequency bands for the feedback threshold measurements are not identical with the frequency bands for the RECD, the matrix is an n×m matrix.

Now, a possible way of obtaining values $m_{kl}$ of the matrix M is described. In a first step, N measurements of both, the feedback threshold and of the RECD are performed (for example, measurements may be performed with N different persons or with different persons in different situations). The RECD may be measured using a known method such as a measurement using a probe microphone placed in the ear. For each measurement the matrix equation $RECD^{(i)}=M*fb^{(i)}$ holds approximately (i=1 . . . N). If the number N is larger than the number of columns of the matrix, the system of matrix equations for the N measurements is over-determined. In this case, it is possible to obtain numerical solutions, such as least square solutions for the matrix coefficients $m_{kl}$. This may be done by known numerical methods. It may for example also be done using commercially available software, such as the MATLAB® software, in which the numerical algorithms are implemented.

According to a first variant, all data are obtained using the same hearing instrument or hearing instrument type on different persons and/or under different circumstances. The thus-obtained values are instrument specific or instrument-type specific. It is, however, also possible to use measurements obtained with various different hearing instruments. Then, universal values, which may be less accurate for certain situations but still are useful, are obtained.

Figure 1:
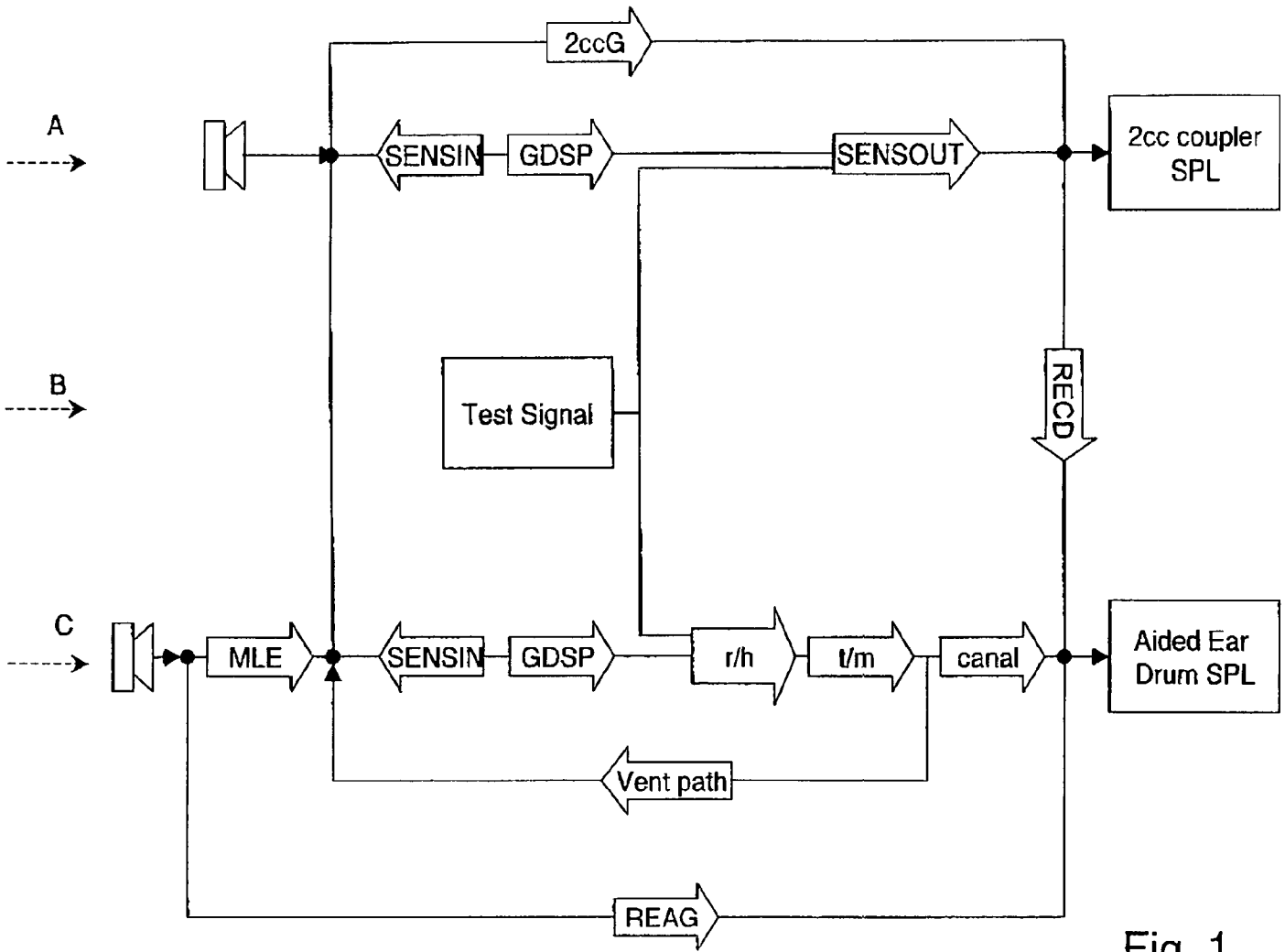
FIG. 1 shows a diagram of gain relations on a hearing instrument with feedback path through the vent.
Figure 2:
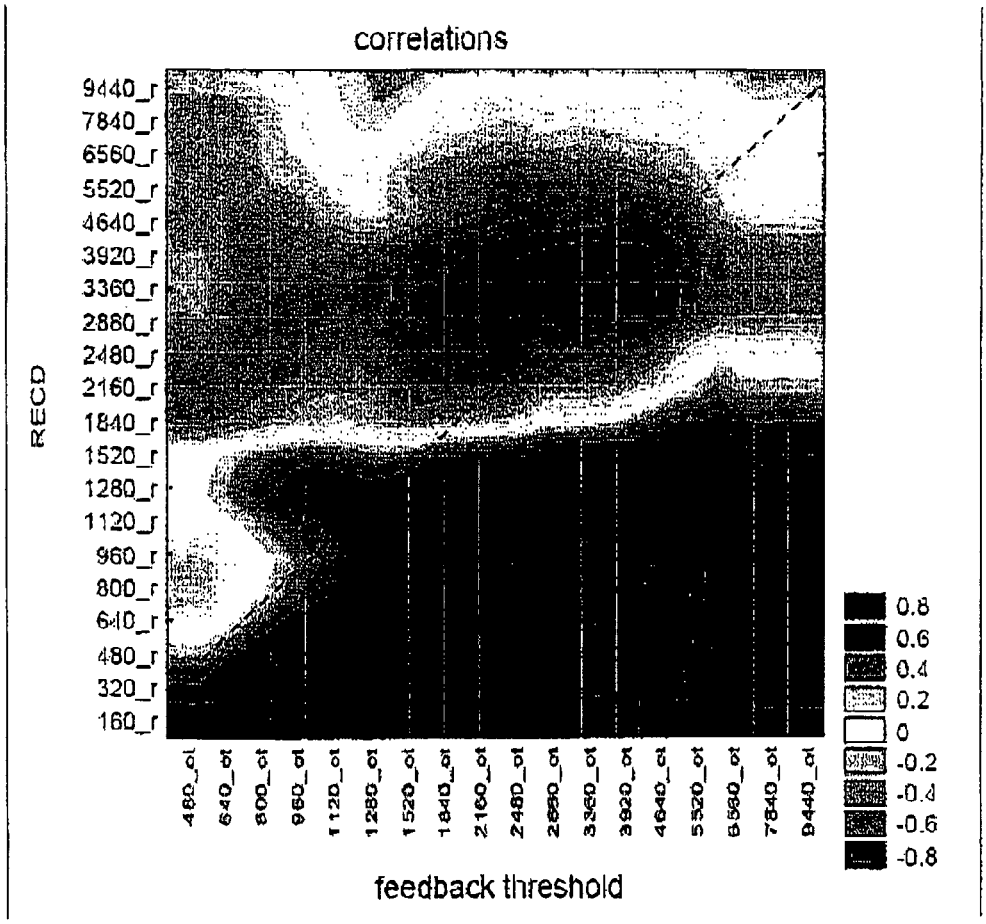
FIG. 2 depicts a correlation matrix between measured feedback thresholds and RECDs for BTE hearing instruments.

For example for 20 frequency bands, the matrix M contains 400 coefficients. It may be expected that not all of them do have a real statistical significance. A further model useable for the RECD prediction is therefore depicted in FIG. 6. The model is, like the model of FIG. 5, based on transformation matrix. In contrast to the model of FIG. 5, the matrix only comprises coefficients of a certain statistical significance. The coefficients are obtained (row by row) by a stepwise regression process, where for example first a least square solution for the most significant coefficient is found, and subsequently the next significant coefficients are calculated. This procedure is terminated after a few steps, typically after 1-4 steps, depending on the desired level of accuracy. As a rule of thumb, it has been observed, that for low frequencies and for very high frequencies, the most significant coefficients are often off-diagonal (which means that there is a strong correlation between the RECD at these frequencies and the feedback threshold at other frequencies), whereas for a center frequency range around 2000-6000 Hz there is a strong correlation between the RECD and the feedback threshold of the same frequency range, i.e. the most significant coefficients tend to be on or near the matrix diagonal. This may also be derived from FIG. 2.

Whereas the method of FIG. 6 entails an increased modeling effort, compared to the model of FIG. 5, and is based on a nonlinear stepping process, it brings about a reliable estimation without there being the extreme outliners. Also, once the model is established, the estimation of the RECD entails very little computational cost.

Yet a further model is shown in FIG. 7. The model is based on the clustering and classification approach. When establishing the model (analysis), a number N of experimentally obtained RECD curves are clustered, i.e. classes of the real ear acoustic coupling quantity or anatomical transfer quantity are formed. This may for example be done by the well-established procedure of k-means clustering. Clustering yields a limited number of RECD curves (four RECD curves in the example of FIG. 7) being the cluster means of the RECD curve clusters. Then, based on the mapping of measured feedback threshold curves to RECD curves, a classification function is established, which is for example based on the discriminant analysis.

As shown in FIG. 7, prediction then includes the steps of classifying new, measured feedback threshold data in accordance with the classification function and then assigning it to the RECD curve that is the cluster means of the cluster the data have been classified to belong to. This method features the substantial advantage that it brings about a well defined and controllable output, namely, the obtained RECD curve is one of a limited number—four in FIG. 7—of known RECD curves. The disadvantage is that the output is not a continuous function of the feedback threshold, and the model is non-linear. Also, the modeling effort is substantial.

Figure 9:
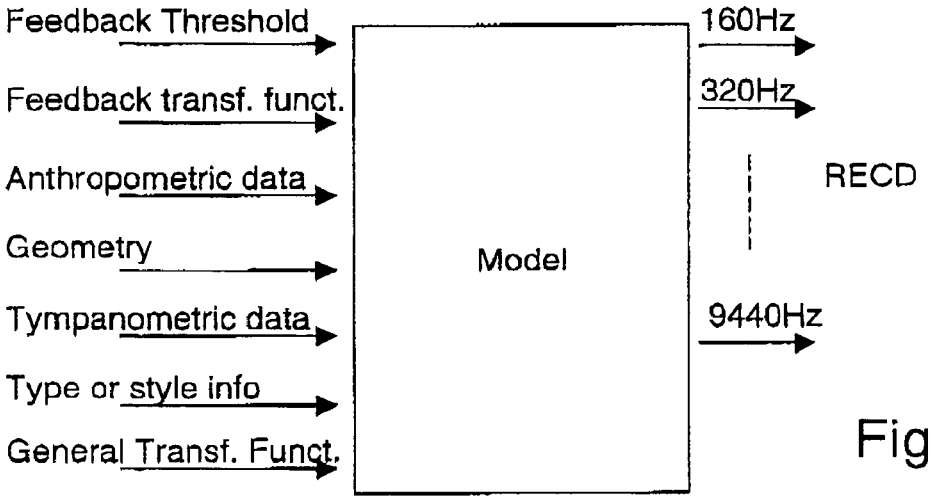
FIG. 9 shows a generalization of the configuration of FIG. 4.

For classification, also additional parameters as mentioned below with reference to FIG. 9 may be used.

Figure 8:
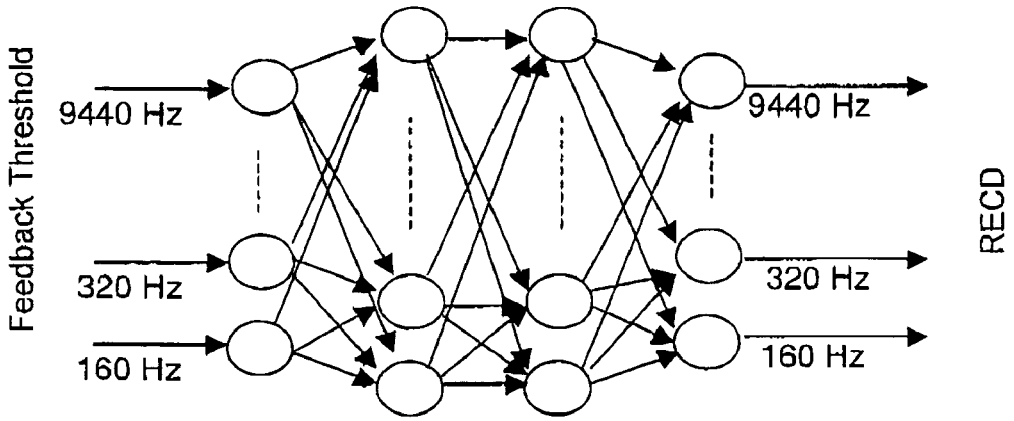
FIG. 8 depicts a neural network model.

Yet another model is depicted in FIG. 8. In accordance with this model, a general neural net is proposed for the linkage of input data with output values. In the basic configuration of FIG. 4, the input values will be feedback threshold values in different frequency bands, whereas the output values are RECD values in different frequency bands. Also the neural network model is established based on measurements of both, RECD and corresponding feedback threshold curves. Methods of training so-called feedforward neural networks are known in the art and will not be described here.

The neural network may be implemented using appropriate hardware. Alternatively, it may be provided by means of a suitable software.

This model features the advantage of being capable of modeling also complex nonlinear relations. The disadvantage is that the modeling does not provide a unique solution, that it is non-linear and that the modeling effort may also be substantial.

The description of all aforementioned models is based on the assumption that the feedback threshold as a function of the frequency is the only input variable. As mentioned, it is possible to have both, a hearing instrument and/or situation specific model or an unspecific model to be applied to different hearing instruments and/or situations. It is, however, also possible to have a general model accounting for the differences in other available variables. An according configuration is shown in FIG. 9. In such a general model, next to the feedback threshold, also other quantities may be used as predictor variables. Such other quantities may for example be taken from at least one of the following categories:

- Feedback transfer function. With the procedure described in EP 1 309 255, the feedback threshold cannot be measured for highest and lowest frequencies because the hearing instrument cannot produce the desired output level. Alternatively, the transfer function of the feedback path could, at least for the mentioned highest and/or lowest frequencies, be measured at a lower level, for example with MLS noise.
- Anthropometric data: These include measured or estimated geometry data of the ear (including the concha), the ear canal, and the head. They may be simple categorical values such as ("small ear", "medium ear", "large ear") or may be more sophisticated, quantitative values.
- Other geometrical data. Such data include vent and/or microphone geometries from hearing instrument fitting software, earpiece modeling software or other sources, the vent diameter, the vent length, the distance vent-to-microphone, vent designation as ordinal or categorical variable (small/medium/large/IROS), etc., as well as an estimation of the residual ear canal volume, for example from dimensions of the ear shell (RSM), visual inspection, etc.
- Tympanometric data, including values of the classical tympanogram, ear canal volume (ECV), peak compliance.
- Type information or style information. Type information is the information about which hearing instrument type or model is used. Style information is a more general information on whether the hearing instrument is a BTE, ITE, ITC, CIC, full shell, half shell etc. hearing instrument.
- General transfer functions from additional sensors (ear canal ("inner") microphone, as mentioned in U.S. patent application Ser. No. 11/196,115 incorporated herein by reference, accelerometer, force sensor, etc)
- Further categorical and/or numerical predictor variables may be used.

Figures 10, 11:
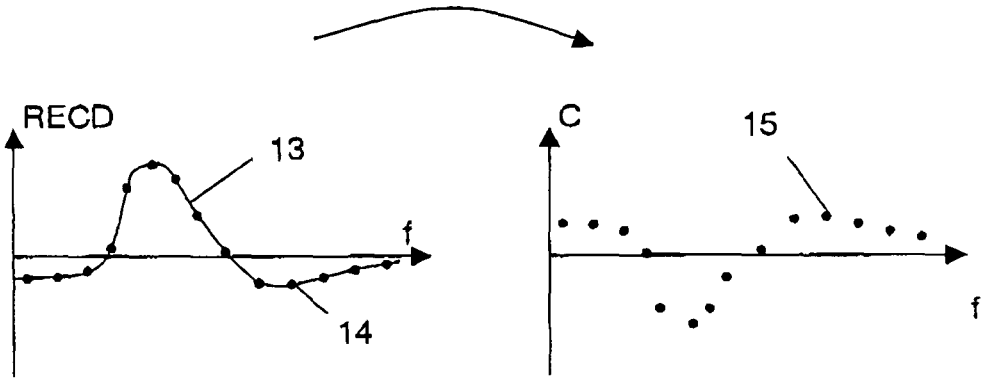
FIG. 10 shows an implementation of the configuration of FIG. 9 by the example of a linear model.
FIG. 11 schematically depicts the evaluation of a gain correction.

The generalization of this kind may be applied to all models previously described referring to FIGS. 5 through 8. An example relating to the linear transformation is shown in FIG. 10. The transfer matrix T comprises a feedback threshold transfer constituent M as well as an additional predictor constituent $M_v$. In the embodiment of FIG. 10, the additional predictor variables account for a frequency dependent correction curve to be (logarithmically) added to the RECD obtained by the transfer matrix constituent M. However, deviating from the embodiment of FIG. 10, it would also be possible to model the prediction in a way in which the RECD prediction based on feedback threshold and the prediction based on other predictor variables are interdependent. This may for example be done by extension of the model of FIG. 7 or the model of FIG. 8 to more variables. Also combinations are possible, for example the classifying of transfer matrices as in FIGS. 5 and 6 according to values of predictor variables (except the feedback threshold).

The skilled person will know various other ways of predicting an output quantity from an input quantity it is related with.

The RECD curves (or other quantities) obtained may be used as fitting parameters or for setting fitting parameters in a hearing instrument. The curve is evaluated by or is supplied to the signal processing stage and preferably has an influence on the effective gain values. For example, if the curve reveals that the real ear acoustic signal in a particular frequency region is suppressed stronger than average, the gain calculated by the signal processing unit based on the input signal and pre-stored information is corrected by a corresponding increase in said frequency region. A simplified example of an evaluation of a gain correction C(f) is very schematically shown in FIG. 11. The RECD as a function of the frequency—represented by a curve 13—From the curve 13, a gain correction C(f) is evaluated. The RECD applied as gain correction may be stored in the signal processing unit and be applied to the gains evaluated thereby during operation of the hearing instrument. Since the RECD is linear and essentially time and acoustic signal independent, so is the gain correction. Therefore, applying the once evaluated gain correction C to the input signal a plurality of times always results in an appropriately corrected gain. The dots 15 in the right panel of FIG. 11 illustrate a discretised version of the gain correction for the case the gain is evaluated discretely in a number of frequency bands. Applying the gain correction may then just be an addition of the correction values $C_f$ (or a subtraction of the stored RECD values) to the calculated gain values. Storing a number of discrete RECD or gain correction values $C_f$ is also a preferred way of storing the RECD in the signal processing unit.

As mentioned, all above models, while they are described referring to the RECD, apply for the prediction of any real ear acoustic coupling quantity or anatomical transfer quantity correlated with the feedback threshold, especially for the CORFIG, the OEG, the MLE and the quantity AC=SENSOUT+RECD. For establishing one of the above models (or an other model), as a first step instead of N times measuring RECD curves and feedback threshold curves, a number of curves of the mentioned quantities and of the feedback threshold is measured. The further steps including prediction are completely analogous to the above described proceeding.

It is possible to make the setting of the fitting parameters—such as gain correction values $C_f$—dependent on one acoustic coupling quantity or anatomical transfer quantity or on a suitable combination of such quantities.

Various other embodiments may be envisaged without departing from the scope and spirit of the invention.

What is claimed is:

1. A method for setting at least one fitting parameter of a digital hearing instrument, the method comprising the steps of:

providing the hearing instrument placed in or at a user's ear, the hearing instrument comprising at least one outer microphone operable to obtain an input signal from an acoustic signal incident on the user's ear, and at least one receiver operable to produce an output acoustic signal for impinging on the user's eardrum, obtaining a transfer function representative of an acoustic transfer from the receiver to the outer microphone, performing a computation of a real ear acoustic coupling quantity or anatomical transfer quantity, wherein in said computation the transfer function is used as an input quantity, and using said real ear acoustic coupling quantity or anatomical transfer quantity to determine the fitting parameter or fitting parameters, wherein the fitting parameter or fitting parameters is/are an adjustment of a gain characteristic of the hearing instrument, wherein for each of a plurality of frequency bands a fitting parameter is set, said fitting parameter being a frequency band gain correction value for correcting a gain which, by a signal processing unit, is applied on an input signal of the signal processing unit.

2. The method according to claim 1, wherein said transfer function is a feedback threshold gain.

3. A method as claimed in claim 2, comprising the step of, prior to performing said computation, determining a signal feedback threshold gain by exposing the hearing instrument, which is inserted into an ear of a user, to an input signal while a compressive gain model is applied in a forward path, and of assessing a signal feedback threshold gain after a steady state has been reached in the hearing instrument.

4. A method as claimed in claim 1, wherein said transfer function is a feedback transfer function.

5. A method as claimed in claim 1, wherein the transfer function is dependent on the signal frequency, and wherein said quantity is also dependent on the signal frequency.

6. A method as claimed in claim 5, wherein an audible part of the acoustic spectrum is divided in frequency bands, and wherein the transfer function is represented by a transfer function value in each frequency band.

7. A method as claimed in claim 6, wherein an audible part of the acoustic spectrum is divided in frequency bands, and wherein in each frequency band a frequency band value of said quantity is calculated.

8. A method as claimed in claim 7, wherein for the computation a multiple input/multiple output model is used, wherein at least some of the multiple inputs are frequency band transfer function values and wherein at least some of the multiple outputs are the frequency band values of said quantity.

9. A method as claimed in claim 1, wherein said real ear acoustic coupling quantity or anatomical transfer quantity is chosen to be a Real-Ear-to-Coupler Difference (RECD), a Microphone Location Effect (MLE), a Coupler Response for Flat Insertion Gain (CORFIG), an Insertion Loss (IL), and/or a Real Ear Open Gain (REOG).

10. A method as claimed in claim 1, wherein in said computation in addition to said transfer function an additional quantity is used as an input quantity, and wherein said additional quantity is at least one of an additional transfer function representative of an acoustic transfer from the receiver to the outer microphone, of anthropomometric data, of geometrical data, of tympanometric data, and of type or style information.

11. A method as claimed in claim 1, wherein the computation includes calculating a linear combination of frequency dependent signal feedback threshold gain values for each one of a plurality of frequency dependent values representative of said real ear acoustic coupling quantity or anatomical transfer quantity.

12. A method as claimed in claim 1, wherein the computation includes assigning the signal feedback threshold gain to a class of signal feedback threshold gains, and choosing a real ear acoustic coupling quantity value or anatomical transfer quantity value representative of a real ear acoustic coupling quantity or anatomical transfer quantity class assigned to said class of signal feedback threshold gains, to be the computed real ear acoustic coupling quantity or anatomical transfer quantity.

13. A method as claimed in claim 1, wherein the real ear acoustic coupling quantity or anatomical transfer quantity is computed using a neural network.

14. A method as claimed in claim 1, wherein the frequency band gain correction value is a logarithmic value to be added to a gain computed by the signal processing unit.

15. A method as claimed in claim 1, wherein said transfer function is a feedback threshold gain, wherein the signal processing unit is operable to apply a signal gain on an input signal to yield an output signal, and wherein said signal gain depends on the signal feedback threshold gain also for signal gain values below the feedback threshold gain value.

16. A method as claimed in claim 15, wherein the fitting parameter or fitting parameters has/have an influence on a gain which, by the signal processing unit, is applied on an input signal of the signal processing unit, wherein said gain depends on an input signal strength, and wherein said fitting parameter has an influence on the gain for all input signal strengths between a hearing threshold level and a maximum level.

17. A digital hearing instrument comprising at least one outer microphone, a signal processing unit with a data memory, and at least one receiver operable to produce an output acoustic signal for impinging on a user's eardrum, the signal processing unit being operable to transform an input signal provided by said at least one outer microphone into an output signal supplied to said at least one receiver, the transformation of the input signal into the output signal defining a signal gain applied by the signal processing unit, the signal processing unit being operable to set at least one fitting parameter of the digital hearing instrument by a method comprising the steps of:

obtaining a transfer function representative of an acoustic transfer from the receiver to outer microphone while the hearing instrument is placed in or at a user's ear, performing a computation of a real ear acoustic coupling quantity or anatomical transfer quantity, wherein in said computation the transfer function is used as an input quantity, and using said real ear acoustic coupling quantity or anatomical transfer quantity to determine the fitting parameter or fitting parameters, wherein the fitting parameter or fitting parameters is/are an adjustment of a gain characteristic of the hearing instrument, wherein for each of a plurality of frequency bands a fitting parameter is set, said fitting parameter being a frequency band gain correction value for correcting a gain which, by the signal processing unit, is applied on the input signal of the signal processing unit.

18. A method for setting at least one fitting parameter of a digital hearing instrument, the method comprising the steps of:

providing the hearing instrument placed in or at a user's ear, the hearing instrument comprising at least one outer microphone operable to obtain an input signal from an acoustic signal incident on the user's ear, and at least one receiver operable to produce an output acoustic signal for impinging on the user's eardrum, obtaining a transfer function representative of an acoustic transfer from the receiver to the outer microphone, performing a computation of a real ear acoustic coupling quantity or anatomical transfer quantity, wherein in said computation the transfer function is used as an input quantity, and using said real ear acoustic coupling quantity or anatomical transfer quantity to determine the fitting parameter or fitting parameters, wherein the transfer function is dependent on the signal frequency, and wherein said quantity is also dependent on the signal frequency, wherein an audible part of the acoustic spectrum is divided in frequency bands, and wherein the transfer function is represented by a transfer function value in each frequency band, wherein in each frequency band a frequency band value of said quantity is calculated, wherein for the computation a multiple input/multiple output model is used, wherein at least some of the multiple inputs are frequency band transfer function values and wherein at least some of the multiple outputs are the frequency band values of said quantity.

19. A method for setting at least one fitting parameter of a digital hearing instrument, the method comprising the steps of:

providing the hearing instrument placed in or at a user's ear, the hearing instrument comprising at least one outer microphone operable to obtain an input signal from an acoustic signal incident on the user's ear, and at least one receiver operable to produce an output acoustic signal for impinging on the user's eardrum, obtaining a transfer function representative of an acoustic transfer from the receiver to the outer microphone, performing a computation of a real ear acoustic coupling quantity or anatomical transfer quantity, wherein in said computation the transfer function is used as an input quantity, and using said real ear acoustic coupling quantity or anatomical transfer quantity to determine the fitting parameter or fitting parameters, wherein in said computation in addition to said transfer function an additional quantity is used as an input quantity, and wherein said additional quantity is at least one of an additional transfer function representative of an acoustic transfer from the receiver to the outer microphone, of anthropomometric data, of geometrical data, of tympanometric data, and of type or style information.

20. A method for setting at least one fitting parameter of a digital hearing instrument, the method comprising the steps of:

providing the hearing instrument placed in or at a user's ear, the hearing instrument comprising at least one outer microphone operable to obtain an input signal from an acoustic signal incident on the user's ear, and at least one receiver operable to produce an output acoustic signal for impinging on the user's eardrum, obtaining a transfer function representative of an acoustic transfer from the receiver to the outer microphone, performing a computation of a real ear acoustic coupling quantity or anatomical transfer quantity, wherein in said computation the transfer function is used as an input quantity, and using said real ear acoustic coupling quantity or anatomical transfer quantity to determine the fitting parameter or fitting parameters, wherein the computation includes calculating a linear combination of frequency dependent signal feedback threshold gain values for each one of a plurality of frequency dependent values representative of said real ear acoustic coupling quantity or anatomical transfer quantity.

21. A method for setting at least one fitting parameter of a digital hearing instrument, the method comprising the steps of:

providing the hearing instrument placed in or at a user's ear, the hearing instrument comprising at least one outer microphone operable to obtain an input signal from an acoustic signal incident on the user's ear, and at least one receiver operable to produce an output acoustic signal for impinging on the user's eardrum, obtaining a transfer function representative of an acoustic transfer from the receiver to the outer microphone, performing a computation of a real ear acoustic coupling quantity or anatomical transfer quantity, wherein in said computation the transfer function is used as an input quantity, and using said real ear acoustic coupling quantity or anatomical transfer quantity to determine the fitting parameter or fitting parameters, wherein the computation includes assigning the signal feedback threshold gain to a class of signal feedback threshold gains, and choosing a real ear acoustic coupling quantity value or anatomical transfer quantity value representative of a real ear acoustic coupling quantity or anatomical transfer quantity class assigned to said class of signal feedback threshold gains, to be the computed real ear acoustic coupling quantity or anatomical transfer quantity.

* * * * *